United States Patent [19]

Klantke et al.

[11] 3,972,303

[45] Aug. 3, 1976

[54] APPARATUS FOR APPLYING AN ADHESIVE TO AN INSOLE

[76] Inventors: Herbert Klantke, Lemberg, Pflaz; Herbert Schindler, Wagenstr. 38, 678 Pirmasens, both of Germany

[22] Filed: Feb. 22, 1973

[21] Appl. No.: 334,885

Related U.S. Application Data

[63] Continuation of Ser. No. 768,755, Oct. 18, 1968, abandoned, which is a continuation-in-part of Ser. No. 627,028, March 30, 1967, abandoned.

[30] Foreign Application Priority Data

Apr. 1, 1966 Germany ..... 69007
May 13, 1966 Germany ..... 38986

[52] U.S. Cl. ..... 118/3; 118/411
[51] Int. Cl.[2] ..... B05C 5/02
[58] Field of Search ..... 118/3, 410, 411, 202; 239/84; 222/146 HE; 401/9, 11, 263, 264, 206, 28, 35

[56] References Cited

UNITED STATES PATENTS

| | | | |
|---|---|---|---|
| 734,704 | 7/1903 | Harrison | 401/28 X |
| 743,430 | 11/1903 | Berg | 401/264 |
| 2,346,951 | 4/1944 | Temple | 118/3 |
| 2,456,687 | 12/1948 | Dominguez | 401/28 X |
| 2,783,735 | 3/1957 | Paulsen | 118/410 |
| 2,871,818 | 2/1959 | Jorgensen | 118/410 X |
| 2,955,564 | 10/1960 | Mattoch | 118/3 |
| 2,995,159 | 8/1961 | Berggren | 222/146 HE X |
| 3,271,800 | 9/1966 | Allard | 118/3 X |
| 3,377,012 | 4/1968 | Cushman | 118/410 X |
| 3,379,167 | 4/1968 | Douglas | 118/3 |
| 3,390,411 | 7/1968 | Benken | 118/410 X |

*Primary Examiner*—John P. McIntosh
*Attorney, Agent, or Firm*—Haseltine, Lake & Waters

[57] ABSTRACT

For applying adhesive to an insole, adhesive supplying tubes are provided which are independently yieldable upon being forced against the shoe part to which the adhesive is to be applied. This accommodates the shape of the shoe bottom and assists in applying the adhesive to various sizes of insoles.

14 Claims, 13 Drawing Figures

APPARATUS FOR APPLYING AN ADHESIVE TO AN INSOLE

This application is a continuation of copending application Ser. No 768,755, filed Oct. 18, 1968, now abandoned, which in turn is a continuation-in-part of application Ser. No. 627,028, filed Mar. 30, 1967, now abandoned.

SUMMARY OF THE INVENTION

This invention relates to apparatus for applying a preferably thermoplastic adhesive to the edge of an insole secured on a last by means of a lasting machine, and more particularly to apparatus of the type including a plunger in which are arranged nozzles with valves which open after the plunger is pressed onto the article to which adhesive is to be applied.

An object of the invention is to provide for bearing tightly on insoles during the application of adhesive thereto and that no excess of adhesive is discharged which is lost and can soil the machine involved.

A certain adaptation to insoles of different widths is possible in known machines due to the use of divided and articulated plunger mechanisms, but expansions in longitudinal and transverse direction cannot be taken into account. In known apparatus, a plunger provided with nozzles is applied to an insole, after which an injector is actuated which opens check valves in the nozzles and injects adhasive therethrough onto the insole. However, since the nozzles are arranged rigidly in the plunger, their distance varies over the length of the area to be cemented, so that more or less adhesive is wasted, thereby soiling the machine and the leather.

This is avoided, in accordance with the invention, in that controls for adhesive feed elements are provided which are yieldably displaceable into the plunger against the action of spring means in order to control the discharge of adhesive. This is achieved, in accordance with one example, in that adhesive feed elements designed as nozzles are slidingly accommodated in bores in the plunger and project from the bores while forming with them a valve seal. These projections bear in opening direction against a compression spring in the plunger.

Due to the principle that, when the plunger is started, one adhesive feed element after the other bears on the insole and is then pressed into the plunger during its further movement so that the respective valves are opened, no adhesive can issue from the nozzles before they bear on the insole. Any waste of adhesive and thus soiling of machine and material are thus avoided.

Compared to known apparatus, this also has the advantage that the injection pressure behind the nozzle can remain even as the apparatus returns to its starting position. Control elements for a piston injector and the piston injector itself can be eliminated if the compression spring is made correspondingly strong. A pressure reservoir can be used instead.

Another advantage, compared to known apparatus, is that the plunger no longer has to be adapted for expansion and it can be used for lasts of different expansion.

An application groove limited at both sides by two flexible bulges can be provided in proximity of the edge of the applicator plunger, these bulges being under overpressure or under spring action so that they bear tightly on all sides, even in the case of deviations of the surface form of the plunger, on the last. Preferably, however, a plurality of adhesive feed elements are provided which can be pressed in against the action of a spring or of a system overpressure or the like. The adhesive then flows through or along these elements to the insole.

In a particularly expedient embodiment of the invention, each feed element is so designed as a valve that it has a sealing surface which is lifted only when the element is pressed into the plunger for releasing the adhesive. This sealing surface can be designed, for example, as a conical segment of the feed element.

According to one embodiment of the invention, the feed element has feed grooves distributed over the circumference; but in another embodiment a central feed channel can be provided which can widen conically outward at its mouth forming a sharp sealing edge.

According to a further embodiment of the present invention, simplification is achieved by the use of pins, provided with longitudinal bores, as adhesive-feed elements, which can be pressed into the face of the plunger against a spring, but which are in continuously open connection with the nozzle port, whereas the latter, or the channel leading to it, is provided inside the plunger, with a shut-off valve. A shut-off valve with an operating lever may also be used for this purpose.

In this latter embodiment of the invention, pins shaped as nozzle jets are slidingly adjustable in bores of the plunger and in idle position, protrude from said bores.

The pins may have feed grooves in circumferential arrangements, and will, in this form, be particularly suitable for utilization with bond-clamping machines in which the insole of the shoe is turned upwards. Pins having a central feed channel bore will be especially useful with such bond-clamping machine, where the insole of the shoe is facing downwards. In the latter case, the pins according to this embodiment also have a feed channel, which widens towards the outer end in a conical flare forming a sharp, tightly sealing edge.

According to the latter embodiment of the invention, each pin is provided on its inside end with a flange-like reinforcement cooperating as a stop with a shoulder in the nozzle port. Where the pins have circumferential supply grooves on their skirts, they are also provided with the reinforcing flange. In this case the open connection to the supply grooves is realized by means of a center-bore supply channel connected by radial bores to the circumferential grooves.

With the apparatus according to the invention, it is possible to use solid plastic adhesives, the applicator plunger being equipped with feed elements pointing downward. The last is then arranged in the machine with the sole pointing upward. The applicator plunger must be heatable. The heating capacity is also recommended when liquid thermoplastic adhesives are used. A heating plate is then assigned, for example, to the plunger which is equipped to keep it at a constant temperature. The other adhesive-carrying parts of the plunger are also preferably heatable.

In another embodiment of the invention is provided a device which feeds solid plastic adhasive from the top to the applicator plunger. The solid plastic adhesive is only molten when it reaches the heated applicator plunger or a heating plate connected with the applicator plunger and is fed from there in liquid form via distributor bores to the applicator plunger.

In the arrangement of the device for processing solid adhesive bars, an adhesive cylinder, preferably equipped with cooling ribs, is provided whose inside diameter is so adapted to the adhesive bars that the latter acts as pistons to drive the adhesive molten in the lower range under pressure through the distributor bores. The feed of the adhesive bars is preferably effectd hydraulically or pneumatically in a way that the free end of the adhesive bar protruding from the adhesive cylinder is pressed by a carrier mount connected with a piston-cylinder arrangement into the adhesive cylinder. The carrier mount and the upper edge of the adhesive cylinder are preferably so provided with pawls that the adhesive bar can only perform a downward movement relative to the corresponding machine parts.

BRIEF DESCRIPTION OF DRAWINGS

FIG. 1 is a side view with the details of the adhesive feed;

DETAILED DESCRIPTION

Figure 1:
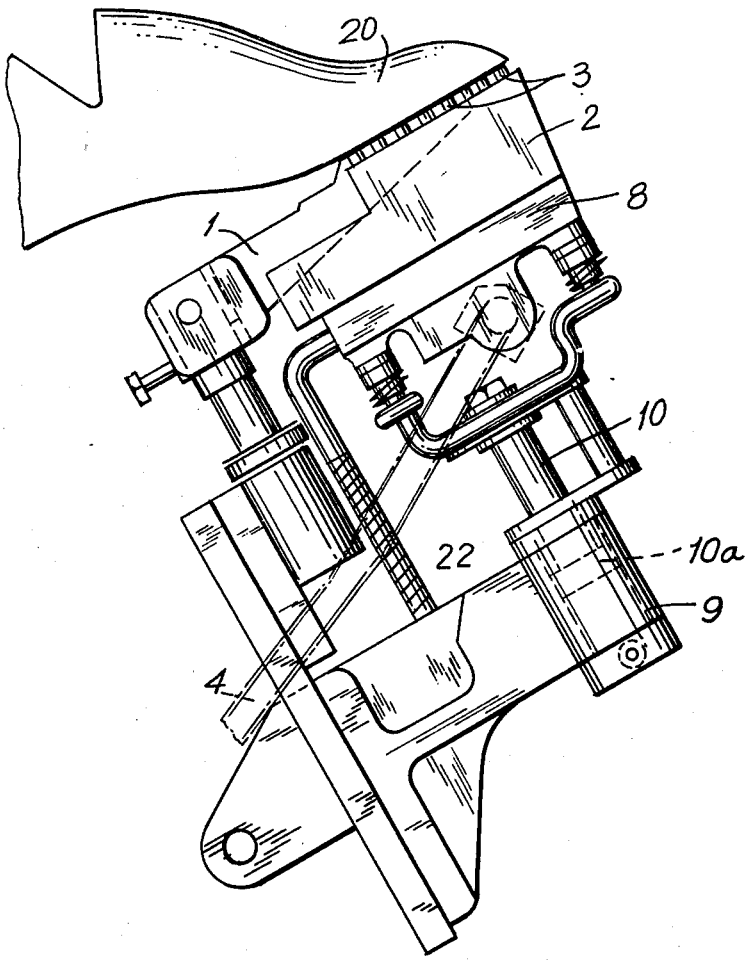
FIG. 1 is a side view of a machine according to the invention.
Figure 3:
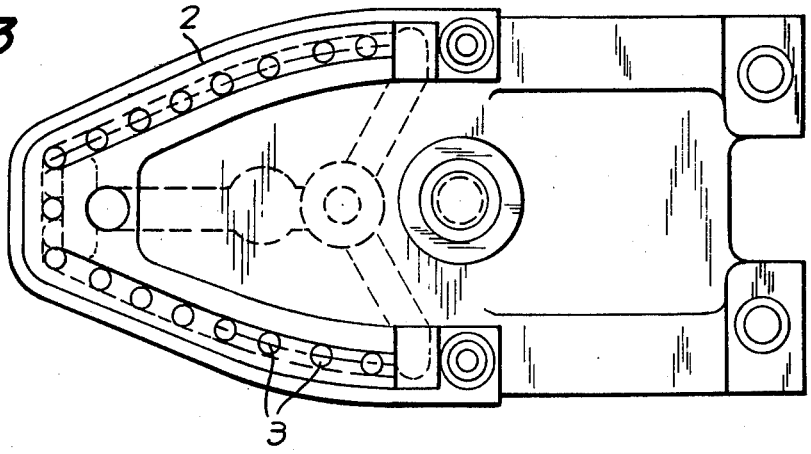
FIG. 3 is a top view of the adhesive feed plunger according to the invention.

In the drawing, FIG. 1 illustrates an applicator plunger 2 from whose application surface protrude adhesive feed elements 3. As can be seen from FIG. 3, a plurality of such feed elements 3 are arranged along the edge of the plunger 2. They can be pressed against the action of a spring 11 into the plunger 2 as can be seen from FIG. 2 (see also FIGS. 4 and 6). They are connected via channel bores 7 and 5 to an adhesive feed line 4, a check valve 6 being provided in the channel system.

Figure 4:
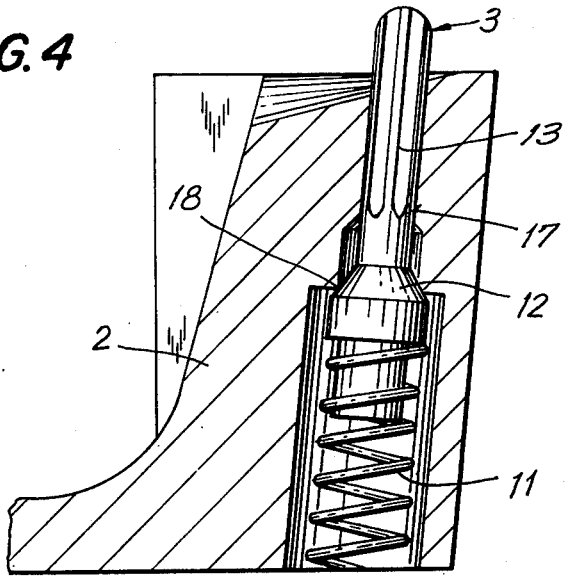
FIG. 4 shows a feed valve.
Figure 6:
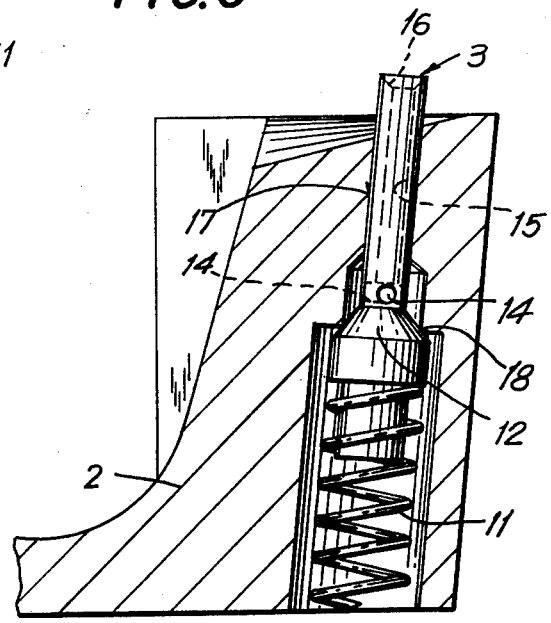
FIG. 6 shows another design of the adhesive feed element.

The feed element shown in FIG. 4 has on its circumference longitudinal grooves 13 through which the adhesive can flow. In the feed element according to FIG. 6 is provided a central or inner bore 15 into which the adhesive enters through connecting bores 14 in order to flow upwardly to the insole. The channel 15 is conically widened at the upper end of the feed element 3 forming a sharp sealing lip which prevents the issuance of excess adhesive when it bears on the insole.

Both illustrated feed elements have, at their bottom end, a sealing cone 12 which cooperates with a corresponding sealing surface of the plunger 2. A spring 11 forces a feed element upward and keeps thus the sealing cone 12 in its closing position. Only when the feed elements are pressed downwardly against the action of the spring can adhesive flow.

The procedure in the course of which adhesive is applied with the machine according to the invention is as follows: At the start, the last 20 rests on the last support 1. The upper of the shoe shaft is held in the pincers and the last support 1 forces the last 20 upwardly into the shaft and performs thus the overhaul process. Pincers and upper are not shown in the drawing, since they are not important for an understanding of the invention. After the overhauling process is completed and before the downwardly protruding upper is gathered and folded over the insole toward the center of the last, the adhesive is applied. The plunger 2, driven by the piston 10*a* running in the cylinder 9 and by the piston rod 10, moves upwardly so that the adhesive feed-elements strike against the insole and the adhesive can issue in the above-described manner. In the embodiment being described, the dosing pump for the adhesive is so coupled with the position of the lifting piston 10*a* that adhesive is only discharged when the upper position has been assumed and the valves 12 of the feed-elements 3 are open.

After the adhesive is discharged, the piston 10*a* and with it the plunger 2 move down again, after which the upper is immediately edged in.

Figure 2:
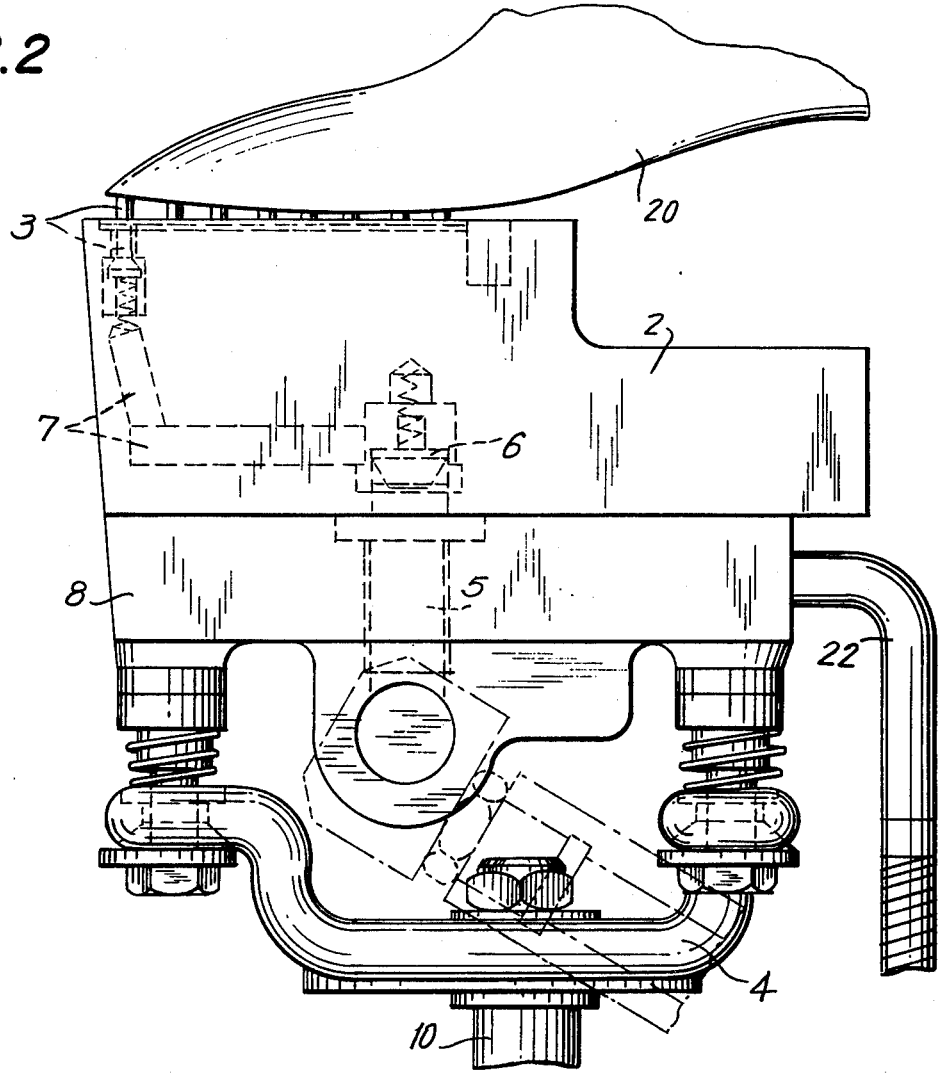
Figure 5:
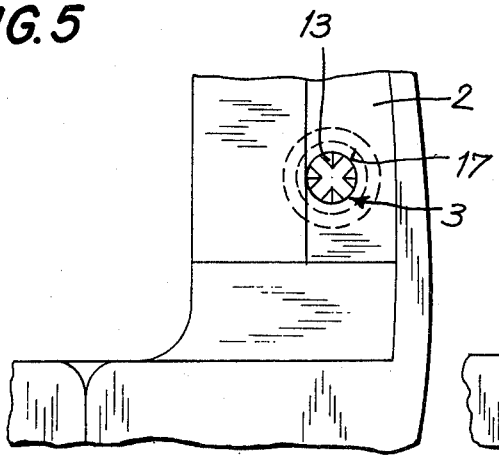
FIG. 5 is a top view of the valve according to FIG. 4.
Figure 7:
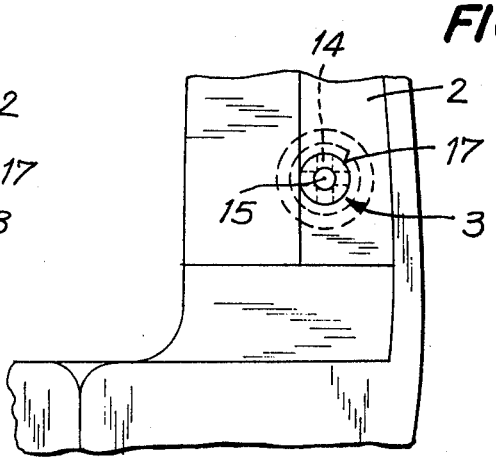
FIG. 7 is a top view of the element according to FIG. 6.

In FIG. 2, element 8 is a heating plate which, being provided with a thermostat, keeps a constant temperature and also keeps the plunger 2 with its distributor bore 7 and the other adhesive-carrying channels at the necessary temperature, as is particularly important when thermoplastic adhesive is used. Other heating elements can also be provided as desired in the plunger 2 itself so that the latter is itself heatable.

Figure 8:
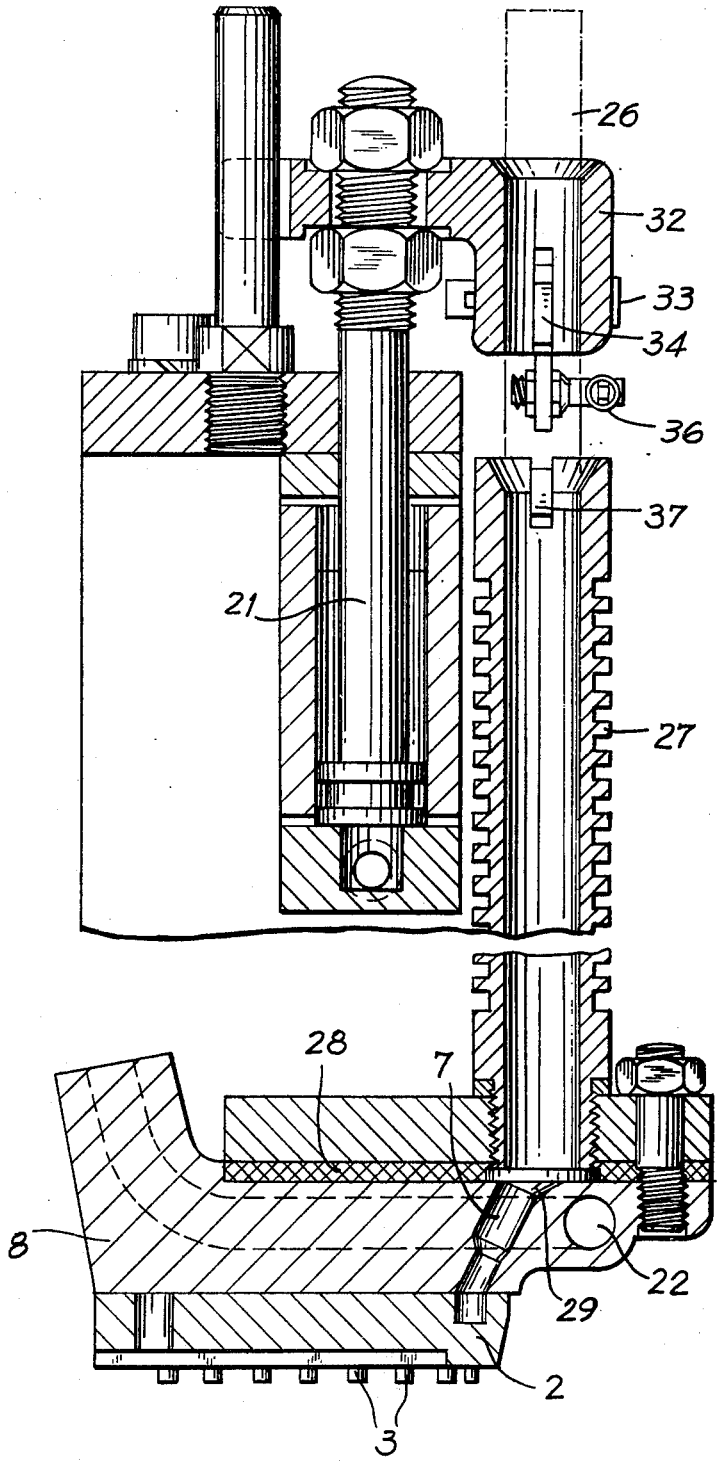
FIG. 8 is a schematic section of a machine according to the ivention.

On the edge of another applicator plunger 2, as shown in FIG. 8, are arranged the feed elements 3 in such a way that they point downwardly for the application of adhesive onto a shoe which is clamped with the insole up. The design of the feed elements 3 as valves, described particularly in FIGS. 4 to 7, prevents liquid adhesive from issuing and dripping downwardly. With the applicator plunger 2 is provided, in heat-conductive contact, a heating plate 8 in which extend heating channels 22. Inside the heating plate 8 are provided adhesive distributor bores 7.

Figure 9:
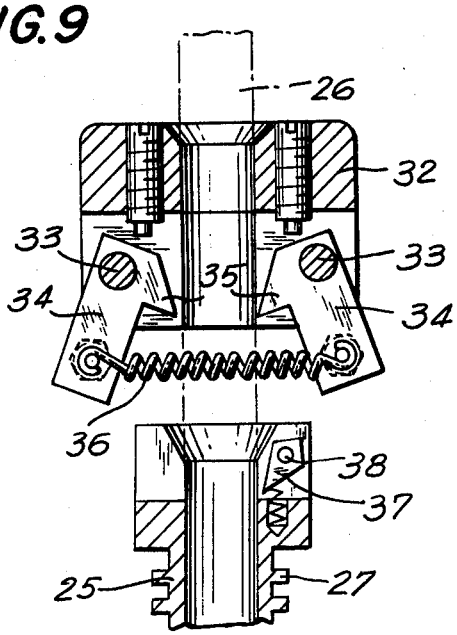
FIG. 9 shows in section a detail of the adhesive feed.

Connected with the heating plate 8, thermally insulated by an insulator 28, is a cylinder 25 (FIG. 9). The open bottom end of this cylinder 25 opens onto a countersunk opening 29 of the heating plate 8 from which start the distributor holes 7 for the adhesive. The cylinder 25 is provided with cooling ribs 27. The cylinder serves to recieve a solid adhesive bar 26 which is advanced by means of a special piston-cylinder arrangement.

The piston-cylinder arrangement 21 controlled by a pressure gas or liquid extends next to and parallel to the adhesive cylinder 25. The upper end of the piston rod 21 is connected with yoke-like carrier mount 32 which has a bore for receiving the upper end of the adhesive bar 26. FIG. 9 shows how this carrier mount is provided with two pawls 34 which are arranged for rotation about the bearing pin 33. Under the action of the spring 36, the tips 35 of the pawls 34 bear on the adhesive bar 26 in such a way that the latter can only perform a relative movement in a downward direction.

During each downward movement of the piston-cylinder arrangement 21, the adhesive bar is thus advanced by a corresponding amount into the adhesive cylinder 25. When the piston-cylinder arrangement moves up, a pawl 37 on pivot 38 provided in the upper edge of the cylinder 25 prevents an upward movement of the adhesive bar 26 so that the tips 35 of the pawls 34 slide along the edge of the adhesive bar while the latter itself does not move up.

The downwardly advanced adhesive bar 26 melts when it strikes the depression 29 of the heating plate 8. The liquid adhesive is fed from there under the action of the unmolten part of the adhesive bar acting as a piston through the distributor bores 7 to the feed elements 3.

Figure 11:
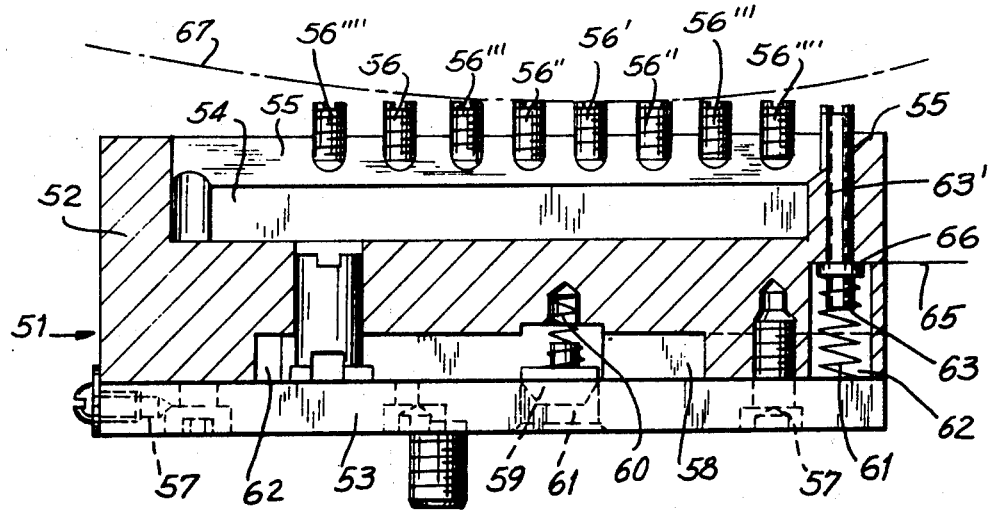
FIG. 11 shows a section along line 11—11 in FIG. 10.
Figure 10:
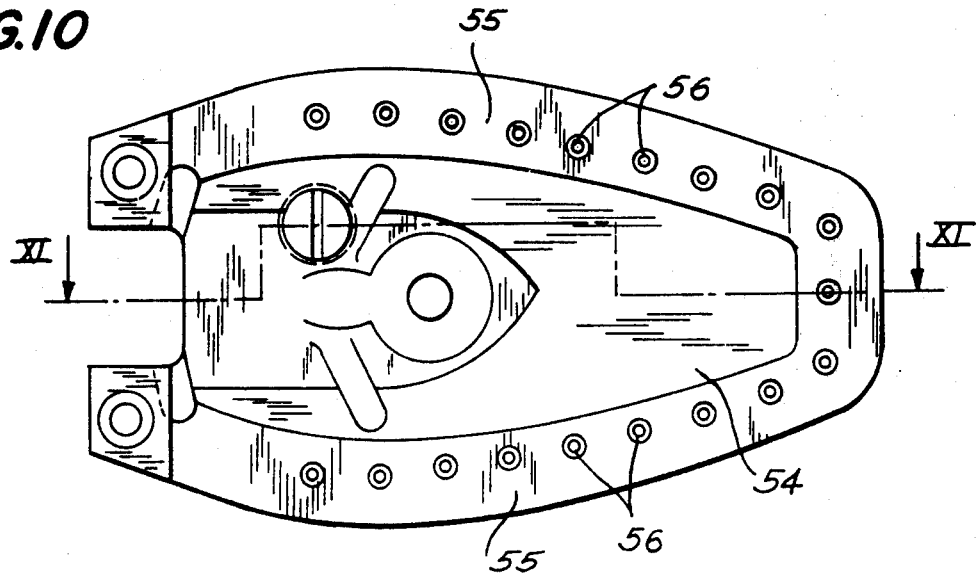
FIG. 10 is a diagrammatic view of the face of a plunger in accordance with another embodiment of the invention.

The plunger 51 in FIGS. 10 and 11 is composed of a body 52 and a cover plate 53. The outer contours of plunger and body are conformed to that of the insole to which the adhesive is to be applied. A tub-shaped reservoir 54 exists inside the body 52 surrounded by an edge 55 the surface of which is inclined towards the tub. From this edge protrude the pins 56 serving as adhesive feed-control elements.

The body 52 and its cover plate 53 are connected by means of screws 57. On the side facing away from the tub, the body 53 contains a main channel 58 for the supply of adhesive. Channel 58 can be shut by a check valve 59 operating against a a valve spring 60 and located in a connecting bore 61 via which is supplied liquid adhesive. Valve 59 prevents the outward flow of adhesive when the applicator is removed from its source (not shown) which includes a control (not shown) for the supply of adhesive. Two channels 62 branch off the main channel 58, and continue around the tub edge 55 to connect to each nozzle port.

Pins 56 are located in the nozzle ports and bear against compression springs 63 which rest on cover plate 53. The nozzle channels 63 are stepped, forming a shoulder 65 and a guide bore 63' for the pins 56. The shoulder 65 serves as stop for the flange 66 of the pins 56.

The insole which may possess a certain curvature or dishing both in longitudinal and transversal direction is schematically represented and referenced as 67.

Figure 12:
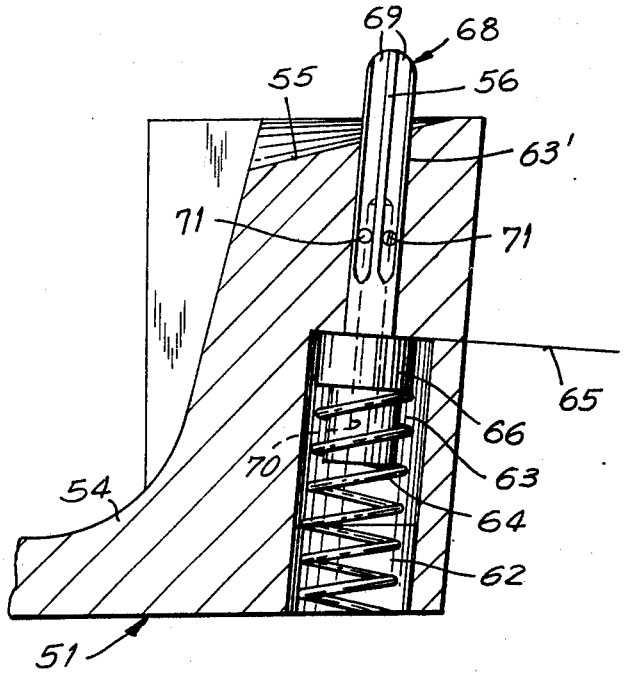
FIG. 12 illustrates a modification of the embodiment of FIG. 10.
Figure 13:
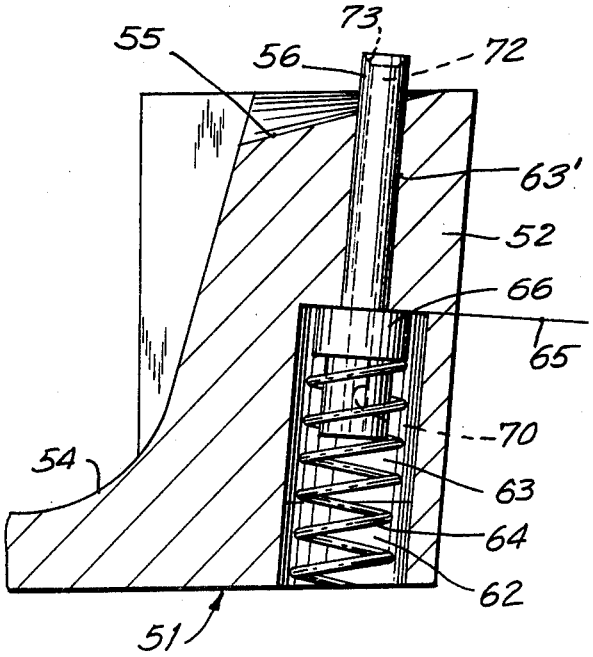
FIG. 13 illustrates a further modification.

In the embodiments of FIGS. 12 and 13, a portion of the body 52 of plunger 51 has been broken away to render a portion of the tub 54 and its edge 55 visible. From the edge 55, a pin 56 protrudes which is provided with a flange 66. The body 52 of the plunger contains the branch channel 62 at the point where the nozzle port 63 opens into its guide bore 63' for the pin 56. Under the load of the compression spring 64, the pin 56 presses with its flange 66 against the shoulder 65 formed by the guide bore 63' and the nozzle port 63. In the skirt of pin 56, which possesses a round head 68, there are supply grooves 69. The end of the pin 56 behind the flange 66 contains a blind bore 70 which continues beyond the flange 66 into the area of the supply grooves 69, where it is connected to the same by radial holes.

The pin 56 of FIG. 13 also contains a center bore 70, except that this pin 56 is provided with center supply channel 70 over its entire length. Due to a conical flare 72, its end is provided with a sharp edge 73. No transverse or radial bores are used in this embodiment, since an open connection always exists from the main channel 58 via the branch channel 62, the valve port 63 and the central supply channel 70 to the flared-out orifice 72. In the embodiment according to FIG. 12, the open connection 62, 63, 70 is completed by the radial bores 71 and the supply grooves 69, through which adhesive is fed to the head 68.

The embodiment shown in FIG. 12 is especially suited for use with bond clamping machines in which the insole faces upwards, and the embodiment shown in FIG. 13 in those cases where the insole faces downwards.

In each case, the plunger 51 is pressed against the insole 67, which offers resistance since it lies on the last of the machine. One after the other the pins 56 come into contact with the insole in the sequence 56', 56'', 56''', 56'''' and are moved in the same sequence into their respective nozzle ports 63, being pressed into the body 52 of the plunger 51. As soon as this contact movement is completed, pressure is increased in the connecting channel 61, the check valve 59 opens and releases the supply of pressure fluid to the insole via the main channel 58, the branch channels 62, the nozzle ports 63, the central supply bores 70, and, if applicable the radial bores 71 and longitudinal grooves 69 towards edges 73 or heads 68 of the pins 56, where these bear upon the insole. Upon release of pressure in the connecting channel 61, the supply of adhesive is shut off and the check valve 59 closes.

Upon a lifting of plunger 51 from the insole 67, the pins 56 move outward again from their guide bores 63' until, under the load of the spring 64, their flanges 66 come up against the stop formed by the shoulder 65 between guide bore 63' and nozzle port 63. The back pressure closes check valve 59. During this action, excessive adhesive flows back into the central supply bores 70.

Since, in this further embodiment, a simple stop mechanism and a constantly open connection take the place of the valve port, there is not only a simplification and economy in production, but also a modification of operation, which becomes even more reliable. Contrary to the conventional adhesive application mechanisms provided with plungers, any adaptation of the shape of the plunger to the curvature or dishing of the insole can be dispensed with, because the pins will automatically conform to the shape of the insole. From this advantage, results the further advantage, that no adhesive is uselessly sprayed out. Instead, the adhesive is cleanly applied exactly where it is needed. Neither the workpiece nor the tool is soiled with excess adhesive.

What is claimed is:

1. Apparatus comprising a carrier for an upper and an insole, a body, means for relatively displacing said body and carrier to urge said body towards the carrier, adhesive distribution means extending from said body and adapted for being applied against the insole, control means for applying a yieldable force against said distribution means to maintain the latter in extended condition, said distribution means being depressible against said force for conforming to the shape of said insole, and adhesive supply means coupled to and supplying adhesive to said distribution means via said body, said distribution means including a plurality of individual plungers arranged along a path conforming to the shape of the pattern of application of the adhesive to the insole, said control means including individual springs respectively acting on said plungers to urge the same outwardly from said body, said body being directly provided with a plurality of adjacent individual smooth bores each respectively slidably accommodating one said plunger, said plungers and bores being of corresponding dimensions such that the plungers are supported without substantial play in the bores, and longitudinal feed means in each plunger for conveying adhesive to the insole and for depositing the adhesive on the insole while the plunger is in contact with the insole whereby each individual plunger independently controls the flow of adhesive to the insole at its respective deposit location and serves as the exclusive means by which adhesive can reach said insole, said body being provided with a central hollow tub including an edge portion bordering the tub and having an inclined face sloping downwardly and inwardly towards the tub, said plungers being disposed in and distributed around said edge portion and individually projecting beyond said inclined face.

2. Apparatus as claimed in claim 1 wherein said body is reciprocable.

3. Apparatus as claimed in claim 1 wherein said plungers and bores include cooperating conical seats and segments.

4. Apparatus as claimed in claim 1 wherein said longitudinal feed means comprises longitudinal grooves in said plungers.

5. Apparatus as claimed in claim 1 wherein said longitudinal feed means comprises internal bores in said plungers and radial openings in the plungers connected to said bores.

6. Apparatus as claimed in claim 5 wherein said internal bores flare conically outward whereby the plungers have sharp edges.

7. Apparatus as claimed in claim 1 comprising heating means connected with said body.

8. Apparatus as claimed in claim 1, comprising check valve means between said adhesive supply means and said bores and responsive to back pressure in said bores for isolating the bores from the adhesive supply means, said bores having shoulders and said plungers including flanges adapted to seat against said shoulders.

9. Apparatus as claimed in claim 8 wherein said longitudinal feed means in said plungers includes channels extending longitudinally therethrough.

10. Apparatus as claimed in claim 8, wherein said longitudinal feed means comprises a channel extending partly through each plunger and at least one axially disposed groove extending the remainder of the way therealong and a radially disposed opening connecting the channel and groove.

11. Apparatus as claimed in claim 1 comprising individual valve means cooperating with respective plungers for controlling feed of the adhesive to the bores, each said plunger being operatively associated with its respective valve means to open the same when the plunger is depressed against the action of the associated spring.

12. Apparatus as claimed in claim 11 wherein said valve means is integral with its respective plunger.

13. Apparatus as claimed in claim 12 wherein said valve means has a sealing surface which is applied against said body to seal the respective bore when the plunger is in outward position in its associated bore.

14. Apparatus as claimed in claim 13 wherein said sealing surface is conical.

* * * * *